US006907829B2

(12) United States Patent
Bambach et al.

(10) Patent No.: US 6,907,829 B2
(45) Date of Patent: Jun. 21, 2005

(54) SHELF EXTENSION

(75) Inventors: John Bambach, Cincinnati, OH (US); Ernest Spencer, Harrison, OH (US)

(73) Assignee: mii, inc., Harrison, OH (US)

( * ) Notice: Subject to any disclaimer, the term of this patent is extended or adjusted under 35 U.S.C. 154(b) by 120 days.

(21) Appl. No.: 10/406,701

(22) Filed: Apr. 3, 2003

(65) Prior Publication Data

US 2003/0172852 A1 Sep. 18, 2003

(51) Int. Cl.[7] ..... A47B 1/00
(52) U.S. Cl. ..... 108/65; 108/90; 108/152
(58) Field of Search ..... 108/69, 75, 152, 108/60, 108, 27, 97; 211/90.01, 88.01, 126.1, 119.003, 134, 153; 248/205.4, 205.1

(56) References Cited

U.S. PATENT DOCUMENTS 143,742 A * 10/1873 Bennor ..... 108/69
177,911 A * 5/1876 Wolf et al. ..... 108/69
2,583,838 A * 1/1952 Hart ..... 108/27
2,678,135 A * 5/1954 Cavanaugh ..... 108/69
3,741,131 A * 6/1973 Leadbetter ..... 108/97
4,088,081 A * 5/1978 D'Arca ..... 108/27
4,606,280 A * 8/1986 Poulton et al. ..... 108/97
4,815,393 A * 3/1989 Pollak ..... 108/69
5,085,154 A * 2/1992 Merl ..... 108/90
5,479,864 A * 1/1996 Kemp ..... 108/27
5,549,054 A * 8/1996 Lewis ..... 108/152
6,142,140 A * 11/2000 Shumaker ..... 108/152

* cited by examiner

*Primary Examiner*—Jose V. Chen
(74) *Attorney, Agent, or Firm*—Frost Brown Todd LLC

(57) ABSTRACT

An extension for a shelf, the shelf having a substantially planar top surface, a plurality of holes in the top surface, and a front edge. The extension includes a substantially planar shelf portion having a front, back, and left and right sides. The front of the planar shelf portion has a curved portion between the left and right sides. A plurality of downward extending tabs are under the planar shelf portion and are arranged in alignment with corresponding holes in a shelf. A lip extends downward from the curved portion of the planar shelf portion. When the extension is installed on a shelf, the tabs engage the holes in the shelf and the planar shelf portion is substantially parallel with and on the planar top surface of the shelf and the lip is positioned in front of the shelf front lip.

21 Claims, 4 Drawing Sheets

SHELF EXTENSION

BACKGROUND

The present invention relates to shelving and shelving systems. Generally, current shelving is fixed in the sense that one cannot expand the size or usable area of a given shelf nor change appearance or shape of a shelf without replacing the shelf altogether. In the past, extensions of various shapes and configurations have been added to shelves, but they were generally bolted to the shelf requiring additional hardware and tools to install the extension. While the need for a simple to install shelf extension could exist in almost any shelving application, there is particular need for quick and low cost options in retail settings for expanding shelves and/or changing the shape of shelves.

BRIEF SUMMARY OF THE INVENTION

One example of the invention is an extension for a shelf. The shelf has a substantially planar top surface, a plurality of holes in the top surface, and a front edge. The extension includes a substantially planar shelf portion having a front, back, and left and right sides. The front of the planar shelf portion has a curved portion between the left and right sides. A plurality of downward extending tabs are under the planar shelf portion and are arranged in alignment with corresponding holes in a shelf. A lip extends downward from the curved portion of the planar shelf portion. When the extension is installed on a shelf, the tabs engage the holes in the shelf and the planar shelf portion is substantially parallel with and on the planar top surface of the shelf and said lip is positioned in front of the shelf front edge.

The foregoing brief description of one example of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

BRIEF DESCRIPTION OF DRAWINGS

While the specification concludes with claims which particularly point out and distinctly claim the invention, it is believed the present invention will be better understood from the following description taken in conjunction with the accompanying drawings, in which like reference numerals identify the same elements and in which:

DETAILED DESCRIPTION

Figure 1:
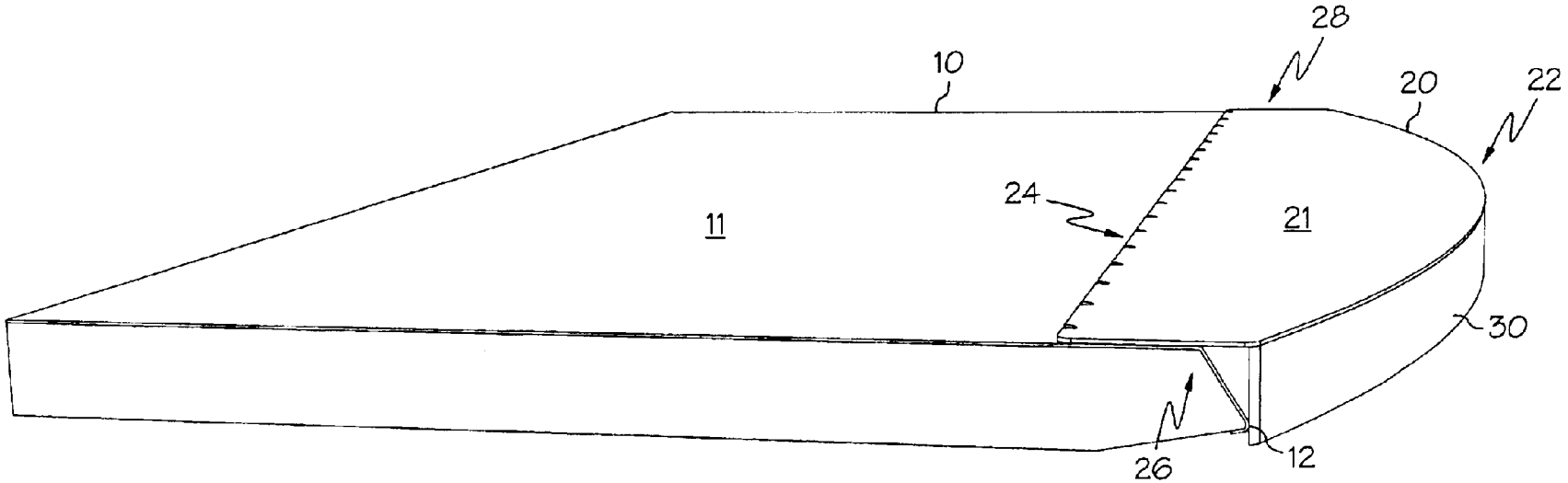
FIG. 1 depicts an isometric view of a shelf with an extension attached thereto.

One example of the present invention is illustrated in FIG. 1. The shelf (10) in the present example includes a substantially planar top surface (11) having a generally rectangular surface area. Attached to the shelf (10) is the shelf extension (20). The extension (20) includes a substantially planar shelf portion (21) having a front (22), back (24), and left and right sides (26, 28). The planar shelf portion (21) extends beyond the front edge of the of the shelf (10), which edge in this example is the front lip (12), thus expanding the usable surface area of the shelf (10). Preferably, the width to the extension (20) is substantially the same as the width of the shelf (10), however, the extension (20) width may be longer or shorter that the shelf (20).

In the present example, the extension front (22) has a curved portion between the left and right sides (26, 28). Accordingly, the extension (20) also changes the appearance and shape of the shelf (10) from a generally rectangular shape to one with a rounded front. As shown in this example, the curved portion of the front (22) extends substantially along the width between the left and right sides (26, 28), however, the curve could also extend only along a portion of the width. While the shape of the curve can vary substantially, in the present example is a convex curve taking the form of a radius. Numerous alternative curves could also be employed, including without limitation concave curves, undulating curves, parabolic curves, elliptical curves, and the like.

A lip (30) extends downward from the curved portion of the front (22). As shown in the present example, the lip (30) is generally C-shaped cross section and extends downward and perpendicular to the planar shelf portion (21). It should be recognized, however, that a variety of other types and shapes of lips (30) are also contemplated, including without circular, curved, diagonal, L-shaped, V-shaped cross-sections, and the like. In addition, it is contemplated that the lip (30) could also extend upwards relative to the planar shelf portion (21). As shown in this example, at the ends of the curve the lip (30) engage the shelf front lip (12), thus providing additional vertical stability for the extension (20). The lip (30) additionally stiffens the extension (20) along its width and its depth.

Figure 2:
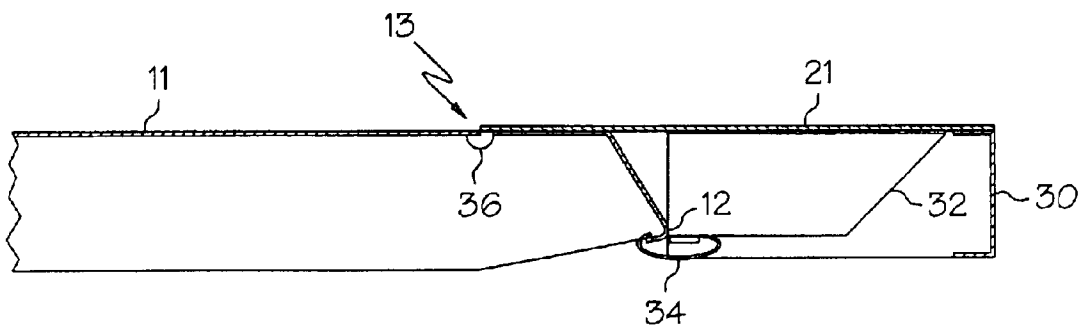
FIG. 2 depicts a cross-sectional side view of the shelf and extension of FIG. 1.

FIG. 2 illustrates a cross-sectional side view of the shelf (11) and extension (21). As show here, the shelf portion (21) in substantially parallel to and laying on the shelf surface (11). A plurality of downward extending tabs (36) are connected to and positioned under the planar shelf portion (21). Tabs (36) are arranged in alignment with corresponding holes (13) in the shelf surface (11). The Tabs (36) engage the holes (13) and prevent up movement of the back (24) of the shelf portion (21). Similarly, the tabs (36) engagement with the holes (13) prevent forward and backward movement of the shelf portion (21) relative to the shelf surface (11). The tabs (36) are positioned along the back (24) of the extension (20). The tabs (36) extend downward from the back of the shelf portion (21). In the present example, the tabs (36) are semi-circular in shape, however, a variety of other shapes could also be employed, including without limitation L-shaped, diagonal shaped, and other shaped tabs. Also in the present example, the tabs (36) are positioned in a line parallel to the left to right (26, 28) axis of the extension (20), however, other configurations are also contemplated. In addition to or as an alternative for the tabs (36), other means may be employed for attaching the extension (20) to the shelf (10), including without limitation adhesives, bolts, screws, rivets, barbs, clips, pins and the like.

Located under the shelf portion (21) is a stiffening member (32). As shown here, only a single stiffening member (32) is provided, however, two or more such stiffening members may be readily employed. In the present example the stiffening member (32) is substantially parallel to the front to back (22, 24) axis of the extension (20). Also in the present example the back of the stiffening member (32) contacts the shelf front lip (12) to provide improved vertical stability of the extension (20). As will be readily appreciated by one with ordinary skill in the art, the extension (20) is capable of rotating about the axis defined by the line of tabs (36). An optional clip (34) engages the shelf front lip (12) and prevents such rotation and prevents upward movement of the extension front (22).

Figure 3:
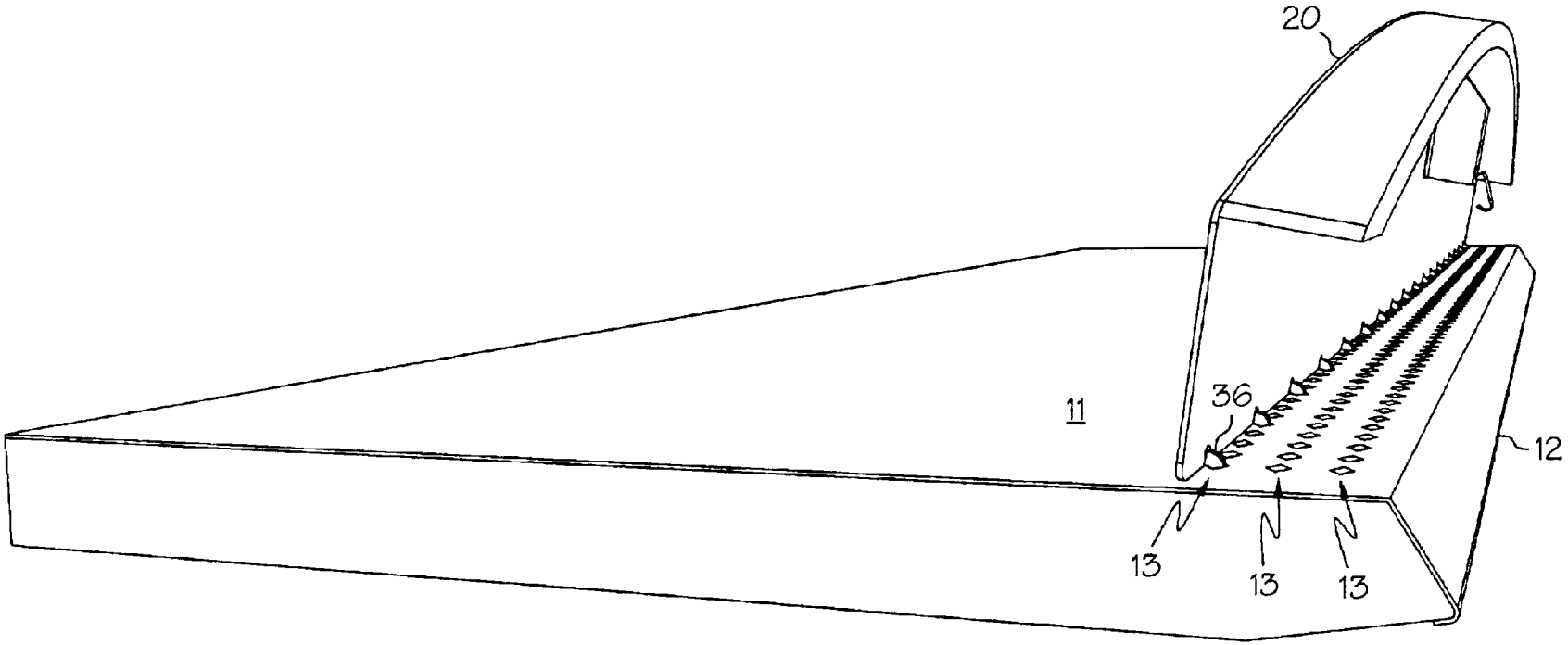
FIG. 3 depicts an isometric view of a shelf with an extension in an upright position.
Figure 4:
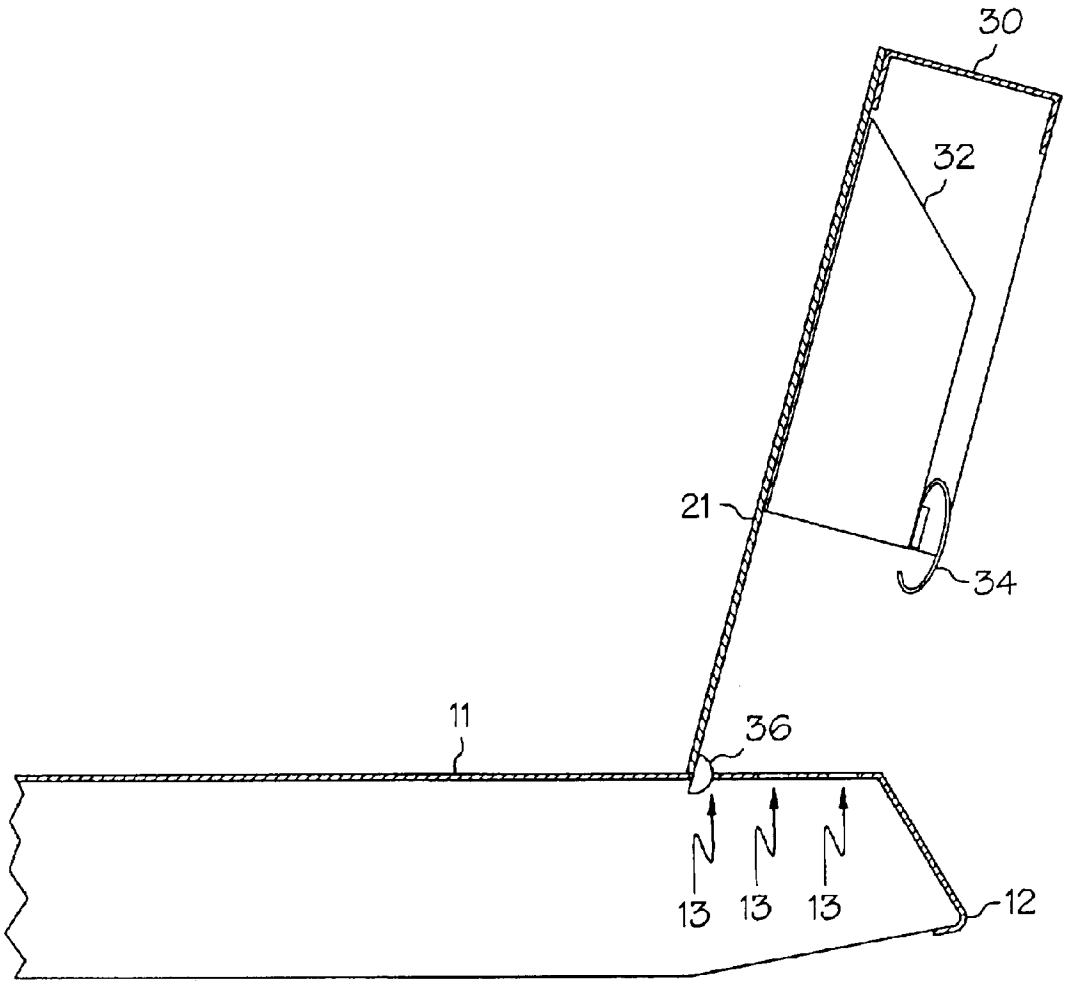
FIG. 4 depicts a cross-sectional side view of the shelf and extension of FIG. 3.

FIGS. 3 and 4 illustrate the rotation of the extension (20) about the tabs (36), as well as the position of the extension (20) for installation or removal. The extension (20) is installed by aligning the tabs (36) into the respective holes (13). As shown in this example, the shelf surface (11) has three rows of diamond shaped holes (13). As will be appreciated, however, any shape or size hole (13) could be employed, including without limitation round, elliptical, oval, square, slots, perforations, and the like. Also note that only a portion of the holes (13) actually have corresponding tabs (36), as such the extension (20) may be installed in various lateral positions on the shelf (10). Once the tabs (36) are aligned and placed in the corresponding holes (13) the extension is rotated clockwise about the tabs until the shelf portion (21) is substantially parallel with the shelf surface (11). The clip (34) may then be fastened to the front lip (12). Removal of the extension (20) involves simply reversing the previous steps. Note that one advantage of having multiple rows of holes (13) is that one can adjust how far the extension (20) in front of the front lip (12).

As one with ordinary skill in the art will readily recognize, one advantage of the present embodiment is that the extension (20) can be quickly installed or removed from the shelf (10) without the use of tools or separate hardware. Optionally, however, separate hardware (e.g. bolts, screws, rivets, barbs, clips, pins and the like) could be employed to make the installation more permanent.

Figure 5:
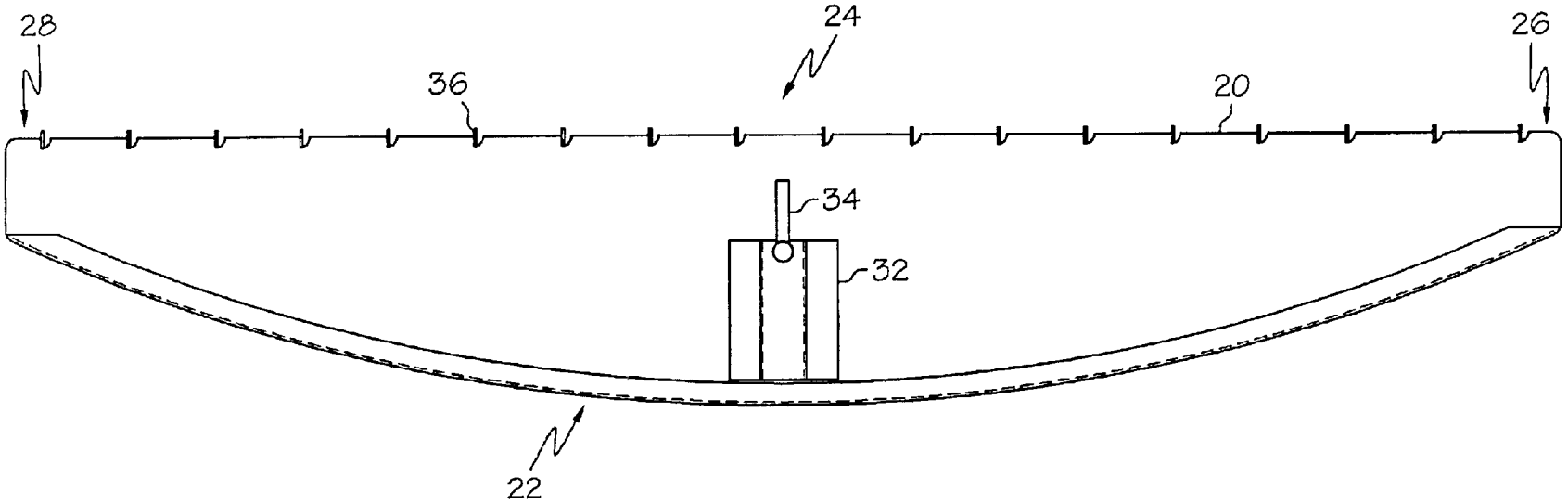
FIG. 5 depicts a bottom view of a shelf extension.

FIG. 5 illustrates bottom view of the extension (20). As is perhaps best seen in this view, the front (22) has a convex radius curve extending from the left to right sides (26, 28). One can also appreciate the quantity and spacing of the tabs (36), however, it should be readily recognized that many variations in the number and spacing of the tabs (36) could also be employed with equal utility.

The extension (20) can be made from a variety of materials, including for example metal, plastic, fiberglass, resins, and other materials used for shelves. The individual components can be integrally formed with one another out of the same material, or separately attached and made from one or more different materials.

Having shown and described various embodiments of the present invention, further adaptations of the methods and systems described herein can be accomplished by appropriate modifications by one of ordinary skill in the art without departing from the scope of the present invention. Several of such potential modifications have been mentioned, and others will be apparent to those skilled in the art. Accordingly, the scope of the present invention should be considered in terms of the following claims and is understood not to be limited to the details of structure and operation shown and described in the specification and drawings.

What is claimed is:

1. An extension for a shelf having a substantially planar top surface, a plurality of holes in the top surface, and a front lip, having a front edge, the extension comprising:

a) a substantially planar shelf portion having a front, back, and left and right sides, the front of the planar shelf portion having a curved portion between the left and right sides;

b) a plurality of downward extending tabs under the planar shelf portion, said tabs being arranged in alignment with corresponding holes in a shelf;

c) a lip extending downward from the curved portion of the planar shelf portion; and d) a clip for engaging a shelf front lip;

wherein when installed on a shelf, the tabs engage the holes in the shelf and the planar shelf portion is substantially parallel with and on the planar top surface of the shelf and said lip is positioned in front of the shelf front edge.

2. The extension of claim 1, wherein the tabs are positioned along the back of the planar shelf portion.

3. The extension of claim 2, wherein the tabs extend downward and to the back of the planar shelf portion.

4. The extension of claim 1, wherein the tabs prevent upward movement of the back of the planar shelf portion relative to the shelf when the tabs engage the holes in the shelf and the planar shelf portion is laid in substantially parallel alignment on the planar top surface of the shelf.

5. The extension of claim 4, wherein the tabs further prevent forward and backward movement of the planar shelf portion relative to the shelf when the tabs engage the holes in the shelf and the planar shelf portion is laid in substantially parallel alignment on the planar top surface of the shelf.

6. The extension of claim 1, further comprising one or more stiffening members positioned under the planar shelf portion.

7. The extension of claim 6, wherein the one or more stiffening members are substantially parallel to the front to back axis of the planar shelf portion.

8. The extension of claim 7, wherein when installed on a shelf the back of the one or more stiffening members contacts the shelf front lip.

9. The extension of claim 1, wherein the width of the extension is substantially the same as the width of the shelf.

10. The extension of claim 1, wherein the curved portion is a convex curve.

11. The extension of claim 10, wherein the convex curve extends substantially along the width between the left and right sides.

12. The extension of claim 1, wherein when installed on a shelf the ends of the lip engage the shelf front lip.

13. The extension of claim 1, wherein the lip extends downward and substantially perpendicular to the planar shelf portion.

14. The extension of claim 1, wherein the installation on a shelf does not require tools or separate hardware.

15. An extension for a shelf having a substantially planar top surface, a plurality of holes in the top surface, and a front lip, the extension comprising:

a) a substantially planar shelf portion having a front, back, and left and right sides, the front of the planar shelf portion having a convex curved portion extending substantially along the width between the left and right sides;

b) a plurality of tabs extending downward and to the back of the planar shelf portion, said tabs being arranged in alignment with corresponding holes in a shelf;

c) one or more stiffening members under the planar shelf portion, said one or more stiffening members being substantially parallel to the front to back axis of the planar shelf portion; and d) a lip extending downward from the curved portion of the planar shelf portion;

wherein when installed on a shelf, the tabs engage the holes in the shelf and the planar shelf portion is substantially parallel and on the planar top surface of the shelf and said lip is positioned in front of the shelf front lip such that the ends of the lip engage the shelf front lip, and the installation does not require tools or separate hardware.

16. A shelf extension, comprising:

a) a substantially planar shelf portion having a front, back, and left and right sides, the front of the planar shelf portion having a curved portion between the left and right sides;

b) means for attaching the planar shelf portion to a shelf and preventing upward movement of the back of the planar shelf portion relative to the shelf; and c) a lip extending downward from the curved portion of the planar shelf portion, wherein when installed on a shelf having a shelf front lip, the ends of the lip engage the shelf front lip.

17. An extension for a shelf having a substantially planar top surface, a plurality of holes in the top surface, and a front lip having a front edge, the extension comprising:

a) a substantially planar shelf portion having a front, back, and left and right sides, the front of the planar shelf portion having a curved portion between the left and right sides;

b) a plurality of downward extending tabs under the planar shelf portion, said tabs being arranged in alignment with corresponding holes in a shelf; and c) a lip extending downward from the curved portion of the planar shelf portion;

wherein when installed on a shelf, the tabs engage the holes in the shelf, and the planar shelf portion is substantially parallel with and on the planar top surface of the shelf, and said lip is positioned in front of the shelf front edge, and the ends of the lip engage the shelf front lip.

18. The extension of claim 17, wherein the width of the planar shelf portion is substantially the same as the width of the shelf.

19. The extension of claim 17, wherein a substantial portion of the lip is curved.

20. The extension of claim 17, wherein the curve of the curved portion is defined by a single radius.

21. The extension of claim 17, wherein the lip comprises a homogenous continuum of material from one end of the lip to the other end of the lip.

* * * * *

UNITED STATES PATENT AND TRADEMARK OFFICE

CERTIFICATE OF CORRECTION

PATENT NO. : 6,907,829 B2
DATED : June 21, 2005
INVENTOR(S) : Bambach et al.

It is certified that error appears in the above-identified patent and that said Letters Patent is hereby corrected as shown below:

Column 3,
Line 67, the phrase "lip, having" should read -- lip having --.

Signed and Sealed this

Twenty-third Day of August, 2005

JON W. DUDAS
*Director of the United States Patent and Trademark Office*